US006736682B1

(12) United States Patent
Groebmair et al.

(10) Patent No.: US 6,736,682 B1
(45) Date of Patent: May 18, 2004

(54) ELECTRICAL PLUG-IN CONNECTOR ELEMENT AND SYSTEM

(75) Inventors: Maximilian Groebmair, Dietramszell (DE); Rudolf Fekonja, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/679,523

(22) Filed: Oct. 6, 2000

(30) Foreign Application Priority Data

Oct. 6, 1999 (DE) ..... 199 48 037

(51) Int. Cl.[7] ..... H01R 13/04
(52) U.S. Cl. ..... 439/692; 439/660; 439/930
(58) Field of Search ..... 439/692, 693, 439/694, 722, 736, 660, 930

(56) References Cited

U.S. PATENT DOCUMENTS

| | | | | | |
|---|---|---|---|---|---|
| 2,275,762 | A | * | 3/1942 | Horton | 439/930 |
| 2,858,515 | A | | 10/1958 | Thunander et al. | |
| 3,425,021 | A | * | 1/1969 | Fow et al. | 439/930 |
| 3,576,516 | A | * | 4/1971 | Mull | 439/930 |
| 3,855,567 | A | | 12/1974 | Harms et al. | |
| 4,392,703 | A | * | 7/1983 | Hall et al. | 439/930 |
| 5,147,510 | A | | 9/1992 | Iura et al. | |
| 5,803,770 | A | * | 9/1998 | Swendson et al. | 439/930 |
| 6,010,369 | A | * | 1/2000 | Itabashi et al. | 439/930 |

FOREIGN PATENT DOCUMENTS

| | | | | |
|---|---|---|---|---|
| DE | 1 465 961 | | 4/1969 | |
| DE | 39 15 611 | | 6/1990 | |
| DE | 195 00 288 | | 7/1996 | |
| DE | 197 54 122 | | 6/1999 | |
| JP | 6 137684 | * | 5/1994 | 439/660 |

* cited by examiner

*Primary Examiner*—Tho D. Ta
(74) *Attorney, Agent, or Firm*—Crowell & Moring LLP

(57) ABSTRACT

An electric plug connecting element and an electric plug connecting system. With the use of a complementary plug connecting element, the plug connecting element enables a disconnectable electric plug connection and includes a housing and a cable, which is run into the housing and is held in the same. The cable includes at least one conductor, enveloped by insulation. Each end is located in the housing and belonging to the conductors is insulated and serves as a contact element for direct contact with the assigned contact elements of the complementary plug connecting element in order to save cost and weight.

6 Claims, 1 Drawing Sheet

ELECTRICAL PLUG-IN CONNECTOR ELEMENT AND SYSTEM

BACKGROUND AND SUMMARY OF THE INVENTION

This application claims the priority of Germany Patent Document 199 48 037.0, filed Oct. 6, 1999, the disclosure of which is expressly incorporated by reference herein.

The invention relates to an electric plug connecting element and system.

In a conventional electric plug connecting element a separate contact member, with which a connection to a contacting point of a complementary plug connecting element can be made, is usually fastened to the stripped end of an electric line. The cable end and the separate contact member are enclosed by a plug housing in order to provide insulation, protection improved handling and to guarantee a reliable and repeatable connection. Frequently the line with its attached contact member floats in the plug housing.

This customary plug construction generates additional costs due to the production and attachment of a separate contact member to the cable end. Moreover, the additional contact parts result in a weight increase of the entire plug connection.

When using an antenna or coaxial cable, it is known to use the conductor of a cable directly as the contact element. In so doing, the insulation on the end of the cable is removed. When fitting together into a socket, the end of the conductor is inserted into a receptacle. To fasten the coaxial cable to another cable or device, a nut, forming one part of the plug connection, is screwed on a housing member of the other cable or the device socket that exhibits an external thread. However, this embodiment can be used only for static applications. For use in an area where there are vibrations and oscillations, it is inappropriate.

German Patent DE 39 15 611 C1 discloses an electric plug connection, where a receptacle member exhibits a plug slit with resilient contact noses. A related plug member exhibits a plug leg with a borehole, through which a cable conductor serving as the contact member is inserted. When fitting together the plug connection, the resilient contact noses are forced apart during insertion into the plug slit, thus dragging the contact member along the contact noses. Thus, the conducting surface of the contact member can be damaged.

German Patent DE 195 00 288 A1 describes an indicating device with an electric contact which extends outward and is able to be removably connected to a counter contact. It is possible to fit together the indicating device and the counter contact element owing to a moveable configuration of the contact or the counter contact and movement of the same over a lever system. However, the presence of vibration may have a negative effect on the contacting and result in a subsequent malfunction.

The object of the invention is to improve an electric plug connecting element and system in such a manner that a simple and inexpensive reliable electric connection of an electric cable is also possible in areas where vibrations and oscillations occur.

The concept of the invention constitutes the direct use of the stripped ends of the conductors of a cable, held in a housing, as the contact elements. In so doing, these conductors are brought directly into contact with the assigned contact elements of a complementary plug connecting element. These measures dispense with a separate contact member, to be adjoined to the conductor. Thus, not only the production of such a contact member but also the process step of providing such a separate contact member at the end of a line can be dispensed with.

The ends of the conductors are accommodated or embedded in the housing in such a manner that a motionless connection is possible between the ends of the conductors and the assigned contact elements of a complementary plug connecting element when connected to the complementary plug connecting element. In particular the connection is also gas tight.

The ends of the conductors can be positioned both close to a housing internal member and to the assigned contact elements of the complementary plug connecting element. With this arrangement the ends of the conductors are pressed together when the electric plug connecting element is joined together with its complementary element so that the result is not only a gas-free but also a motion-free electrical connection between the electrically conducting elements of both plug connecting elements. Thus, the reliability of the plug connection is also guaranteed in areas of application, where oscillations, vibrations or their forces affecting the electrical connection occur.

Furthermore, the housing with the stripped ends of the conductors is designed in such a manner that, when fitting together with the complementary plug connecting element, an essentially frictionless contact, without any plug-in force, is possible. This measure serves especially to avoid surface damage when fitting together the two conducting parts that serve as the contact elements. If the ends of the conductors and the contact elements of a complementary plug connecting element lie one above the other when fitting together both plug connecting elements, then they rub against each other, thus possibly damaging or impairing the surface of the various conductors. This situation can be prevented in the conventional manner by treating the surface with a frictionless material, like gold. To avoid such an expensive surface treatment, the electrical plug connecting elements, especially the housings, which are to be fitted together, can be designed in such a manner that the ends of the conductors and the contact elements do not touch in the first step of the fitting together operation. After essentially completing the fitting together operation of the two housings, the related ends of the conductors and the contact elements ought to be brought into contact with each other without sliding friction and into their end position by another relative motion of the housings. In so doing, the additional relative motion can include swivelling, twisting, tilting or a combination of these motions.

A preferred embodiment of the invention is characterized by the fact that the ends of the conductors are shaped and/or surface treated. For example, for use of multicore strands it is possible to tin coat or to treat the surfaces in some other manner so that a suitable contact element with a good transition resistance can be created out of the conductor. In so doing, the surface treatment also serves to protect the ends of the line.

In addition, it is possible to process the shape of the ends of the conductors. For example, they can be bent or deformed in another defined manner. Therefore, larger adjoining areas between the ends of the conductors and the contact elements of the complementary plug connecting element can be created. Additionally, it is possible to provide optimal shapes for fitting together the electric plug connecting element of the invention, on the one hand, and the complementary plug connecting element, on the other hand.

Naturally both aforementioned kinds of treatment can also be combined. For example, the ends of the conductors can be tin coated and subsequently shaped or deformed.

It is also advantageous for the two housing members to be held in their end position with a locking connection. In this respect it is necessary to provide a locking element on the housing of the electrical plug connecting element. This locking element acts together with a counter element on the complementary plug connecting element.

According to a another embodiment, the housing is molded or cast on the cable and is made preferably of a plastic material.

In the design of both the housing of the electric plug connecting element as well as that of the complementary plug connecting element there is, in essence, a high degree of design freedom. Thus, the housings can be constructed in such a manner that the two housings of the plug connecting elements are connected together by relative rotation. As an alternative, the two housings can be fitted together, first, by linear displacement and then brought into a final position by an opposing swivel motion, after which the contacts of the electrical plug connecting elements lie one above the other. It is an essential feature of the invention that the ends of the conductors serve directly as the contact elements for making direct contact with the assigned contact elements of the complementary plug connecting element.

Naturally the complementary plug connecting element can also be designed so that the contact elements are formed by the conductors themselves.

Other objects, advantages and novel features of the present invention will become apparent from the following detailed description of the invention when considered in conjunction with the accompanying drawings.

DETAILED DESCRIPTION OF THE DRAWINGS

Figure 2:
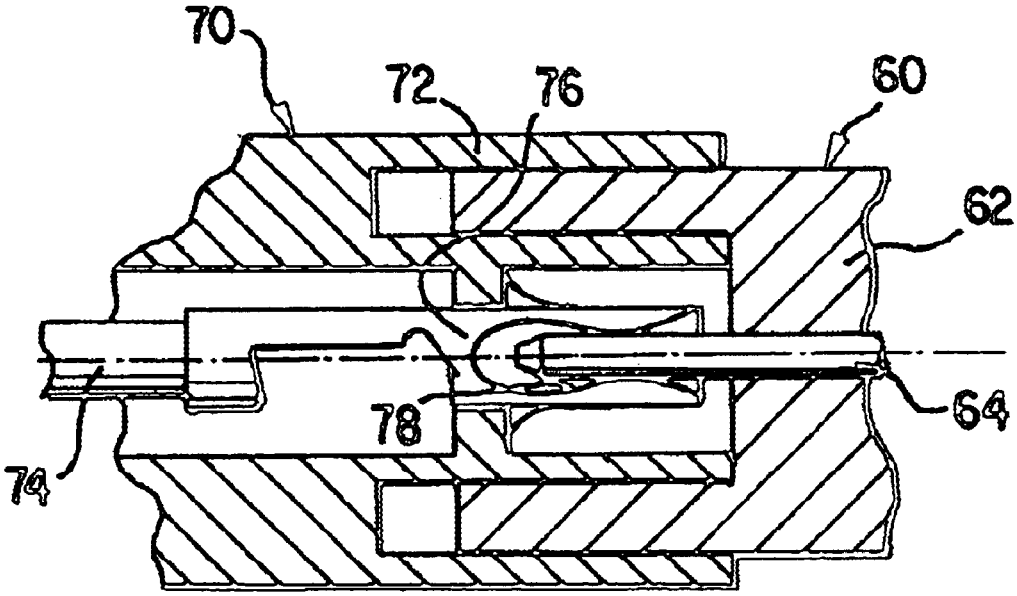
Fig. 2 PRIOR ART
FIG. 2 depicts a conventional electric plug connection.

A conventional electric plug connection, as depicted in FIG. 2, comprises two plug connecting elements 60 and 70, which are fitted together. The plug connecting element 60 comprises a cylindrical housing 62, whose cross section exhibits a U-shaped profile. A contact pin 64, which projects into the cavity, is accommodated coaxially in the housing 62. The housing 62 is an existing element of a device (not illustrated in detail) and fastened to the same. The contact pin 64 extends into the device itself and constitutes an electrical connection to another electric conductor.

A housing 72 of the second electrical plug connecting element 70 is designed complementary to the housing 62 and to slide into or onto the same. The electric plug connecting element 70 comprises, in addition to the housing 72, a line 74 with an electric conductor. The end of this line 74 is stripped, and a separate contact member 76 is fastened thereto. The separate contact member is made completely of metal and exhibits on its front end a mouth-like opening 78, into which the contact pin 64 slides when fitting together the two housings 62 and 72 to form an electrical connection. During the process of sliding the contact pin 64 into the mouth-like opening 78, the contact pin is easily forced apart.

Figure 1:
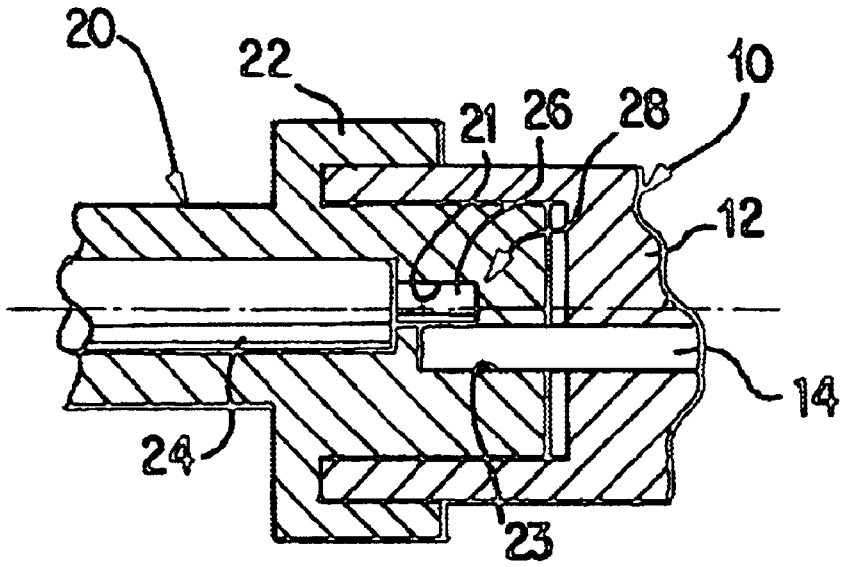
FIG. 1 is a longitudinal view of an electric plug connection with a plug connecting element of the invention.

FIG. 1 depicts an example of an electric plug connection, according to the invention, which eliminates the need for the separate contact member 76 of a conventional plug connection, according to FIG. 2. The electric plug connecting element 10, depicted in FIG. 1, corresponds to the one marked with the reference numeral 60 in FIG. 2. In this respect there is a housing 12, fastened to a device. The housing exhibits an essentially U-shaped profile and accommodates a contact pin 14.

A plug connecting element 20, designed according to the present invention, is to be connected to the electric plug connecting element 10. This plug connecting element 20 comprises a cable, which is run into a housing 22 and is enveloped by the same. The housing 22 is molded in particular to the cable and is made of plastic.

A stripped end of the cable 24 having the conductor 26 is tin-coated, on the one hand, and, on the other hand, is deformed in such a manner that as large as possible a contact surface with the contact pin 14 of the complementary plug connecting element can be formed. In the housing 22 there is a recess 23, into which contact pin 14 slides when fitting together the two housings 22 and 12. The end of the conductor 26 is now arranged in such a manner in the housing that it rests, on the one hand, against a housing inside wall 21 and, on the other hand, is accessible from the recess 23. When fitting together the two housing members 12 and 22, the contact pin 14 slides into the recess 23 and, in so doing, makes contact with the treated end of the conductor 26.

In this respect the two housings 22 and 12 are designed complementary to each other so that they can slide together so as to form a shape lock. In fact, they can slide together until the contact pin 14 makes significant contact with the end 28 of the conductor 26.

Owing to the suitable design of the housing 26 and the solid contact of the contact pin 14 with the end of the conductor 26, a gas tight and motion-free electric connection is produced that is characterized by its reliability. The two housings 22 and 12 can be locked (not illustrated) by a lock connection so that disconnecting the disconnectable connection is possible only with resistance. Thus, an unintentional disconnection of the connection is avoided.

In an alternative embodiment of the invention, the housings to be connected together are designed in such a manner, that, when fitting together the housings, the end 28 of the conductor 26 does not touch the contact pin 14. Not until a relative motion (swivelling, twisting) after the virtually complete fitting together of both housing members 12 and 22 are the ends 28 of the conductors 26 brought slidingly into contact. With this method it is possible to avoid damaging the conductor surfaces through friction.

Of course, the invention can be applied to connecting elements with a plurality of conductors. For a better overview, only one electrical connection is shown in FIG. 1. Furthermore, the design of the housings is within the design sphere of a design engineer and can be defined by the application.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electric plug connecting element for forming a disconnectable electric plug connection with a complementary plug connecting element, said electric plug connecting element comprising:

a housing;

a cable passing into and held in said housing, said cable including at least one insulated conductor wherein an end of each of said at least one conductor is positioned inside of said housing and is stripped of said insulation, said end of each of said conductors providing a contact element for a direct contact with an assigned respective contact element of the complementary plug connecting element, wherein said ends of said conductors are embedded in said housing in such a way that when, in a connected state with said complementary plug connecting element, a fixed connection between the ends of the conductors and the assigned contact elements are provided and wherein the ends of the conductors make pressed contact with the respective assigned contact element of the complementary plug connecting element; and said housing containing said stripped ends of said conductors is designed to provide contact between the conductors and the assigned respective contact element of the complementary plug connecting element without sliding friction wherein a central longitudinal axis of each of said at least one conductor is offset from a central longitudinal axis of each of said at least one assigned respective contact element during said contact.

2. The electric plug connecting element according to claim 1, wherein the ends of the conductors are at least of one of shaped and surface treated.

3. The electric plug connecting element according to claim 1, wherein said housing further includes at least one locked element which interacts with a counter element on the complimentary plug connecting element to form a locking connection.

4. The electric plug connecting element according to claim 1, wherein said housing is molded or cast on the cable.

5. The electric plug connecting element according to claim 1, wherein said housing is plastic.

6. An electric plug connection system including at least one first electric plug connecting element and at least one second plug connecting complimentary element, said first electric plug connecting element comprising a first housing and a cable passing through and held in said housing and said cable including at least one insulated conductor wherein each end of said at least one insulating conductor is fixedly positioned in said housing and is stripped and serves as a contact element for direct contact with second assigned contact elements of corresponding ones of said at least one second plug connecting element wherein the ends of the conductors are embedded in the first housing in such a manner that, when in the connected state with the second plug connecting element, a motionless connection between the ends of the conductors and the assigned contact elements of the second plug connection element occurs and the ends of the conductors make press contact with the respective assigned contact elements of the second plug connecting elements;

wherein said second plug connecting element has a second housing for fixedly holding said assigned contact elements and wherein said assigned contact elements correspond to the number of conductors;

wherein the first and second housings are designed that, when fitting together said first and second plug connecting elements, the ends of the conductors and the ends of the assigned contact elements do not touch and wherein the first and second housings form interacting housing elements which, after completion of a fitting operation of the first and second housings, provide that assigned ends of the conductors and the assigned contact elements are each brought into at least one of pressed contact with each other without sliding friction and brought into a final end position by a subsequent relative motion between said first and second housings; and wherein a central longitudinal axis of each of said at least one conductor is offset from a central longitudinal axis of each of said at least one assigned respective contact element after completion of said fitting operation.

* * * * *